US009907440B2

(12) United States Patent
McClean

(10) Patent No.: US 9,907,440 B2
(45) Date of Patent: Mar. 6, 2018

(54) BACK SCRUBBING ASSEMBLY

(71) Applicant: Judie McClean, Mattapan, MA (US)

(72) Inventor: Judie McClean, Mattapan, MA (US)

( * ) Notice: Subject to any disclaimer, the term of this patent is extended or adjusted under 35 U.S.C. 154(b) by 77 days.

(21) Appl. No.: 15/068,102

(22) Filed: Mar. 11, 2016

(65) Prior Publication Data

US 2017/0258276 A1 Sep. 14, 2017

(51) Int. Cl.
*A47K 3/20* (2006.01)
*A47K 7/02* (2006.01)
*A47K 7/03* (2006.01)

(52) U.S. Cl.
CPC ..... *A47K 7/024* (2013.01); *A47K 7/03* (2013.01)

(58) Field of Classification Search
CPC ..... E03D 9/08
USPC ..... 4/420.5, 420
See application file for complete search history.

(56) References Cited

U.S. PATENT DOCUMENTS 5,175,896 A * 1/1993 Zamir ..... A47K 7/024 15/160
5,311,635 A * 5/1994 Moore ..... A47K 7/024 15/210.1
D388,547 S * 12/1997 Walls ..... A47K 7/024 D28/63
D450,158 S * 11/2001 Swann ..... A47K 7/024 D28/63
6,370,722 B1 * 4/2002 Duckworth ..... A47K 7/024 15/104.92
6,427,279 B1 * 8/2002 White, Jr. ..... A47K 7/024 15/104.92
6,568,029 B1 * 5/2003 Letts ..... A47K 7/024 15/106
6,647,564 B1 * 11/2003 Smith ..... A47K 7/024 15/176.5
7,124,465 B1 * 10/2006 Kaminstein ..... A47L 13/16 15/118
7,155,769 B1 * 1/2007 Baker ..... A47K 7/03 15/104.92
7,266,851 B1 * 9/2007 Batalini ..... A47K 3/281 4/574.1
7,434,287 B1 * 10/2008 Borges ..... A47K 7/024 15/104.92
7,467,438 B2 * 12/2008 Ryman ..... A47K 7/024 15/160
D620,713 S * 8/2010 Polser ..... A46B 11/0058 D28/63
8,297,232 B2 * 10/2012 Clayson ..... A01K 13/002 119/615
D677,003 S * 2/2013 Jones ..... A01K 13/002 D28/63
8,621,679 B1 * 1/2014 Donikian ..... A47K 7/024 15/21.1

(Continued)

FOREIGN PATENT DOCUMENTS

WO WO2011155913 12/2011

*Primary Examiner* — Lori Baker

(57) ABSTRACT

A back scrubbing assembly includes a reservoir that may be filled with a liquid soap. The reservoir may be coupled to a wall in a shower. A plurality of couplers is provided and each of the couplers is coupled to the reservoir. Each of the couplers may engage the wall in the shower. A plurality of cleaning members is provided. A selected one of the cleaning members is removably coupled to the reservoir. Thus, the selected cleaning member may scrub a back of a user.

4 Claims, 5 Drawing Sheets

(56) References Cited

U.S. PATENT DOCUMENTS

| | | | | |
|---|---|---|---|---|
| 8,631,523 | B1 * | 1/2014 | Schneider | A47K 7/024 4/606 |
| D699,001 | S * | 2/2014 | Kennard, Jr. | A01K 13/002 D28/63 |
| 8,726,445 | B1 * | 5/2014 | Wagner | A47K 7/024 15/160 |
| D721,850 | S * | 1/2015 | Pottinger | A47K 7/024 D28/63 |
| 9,015,892 | B1 * | 4/2015 | Figel | A47K 7/024 15/160 |
| D743,659 | S * | 11/2015 | Reger | A47K 7/024 D32/40 |
| D750,841 | S * | 3/2016 | Lewis | A47K 7/024 D24/211 |
| 9,301,655 | B1 * | 4/2016 | Coleman | A47K 7/024 |
| 9,301,656 | B2 * | 4/2016 | Lee | A47K 7/024 |
| D759,221 | S * | 6/2016 | Salvani | A47K 7/024 D23/304 |
| 9,420,921 | B1 * | 8/2016 | Mercado | A47K 7/024 |
| D766,510 | S * | 9/2016 | Bowser | A47K 7/024 D28/63 |
| D767,208 | S * | 9/2016 | Cera | A47K 7/024 D28/63 |
| D780,999 | S * | 3/2017 | Price, III | A47K 7/024 D28/63 |
| 2001/0039676 | A1 * | 11/2001 | McDowell | A47K 7/024 4/606 |
| 2002/0117185 | A1 * | 8/2002 | Simon | A47K 7/024 134/6 |
| 2003/0167565 | A1 * | 9/2003 | Yoshida | A47K 7/04 4/606 |
| 2005/0229347 | A1 * | 10/2005 | Dent D'Almuano | A47K 7/024 15/160 |
| 2006/0107473 | A1 * | 5/2006 | Torres | A47K 7/024 15/21.1 |
| 2009/0113616 | A1 * | 5/2009 | Daly, Sr. | A46B 11/0058 4/606 |

* cited by examiner

BACK SCRUBBING ASSEMBLY

BACKGROUND OF THE DISCLOSURE

Field of the Disclosure

The disclosure relates to scrubbing devices and more particularly pertains to a new scrubbing device for scrubbing a user's back while the user bathes.

SUMMARY OF THE DISCLOSURE

An embodiment of the disclosure meets the needs presented above by generally comprising a reservoir that may be filled with a liquid soap. The reservoir may be coupled to a wall in a shower. A plurality of couplers is provided and each of the couplers is coupled to the reservoir. Each of the couplers may engage the wall in the shower. A plurality of cleaning members is provided. A selected one of the cleaning members is removably coupled to the reservoir. Thus, the selected cleaning member may scrub a back of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
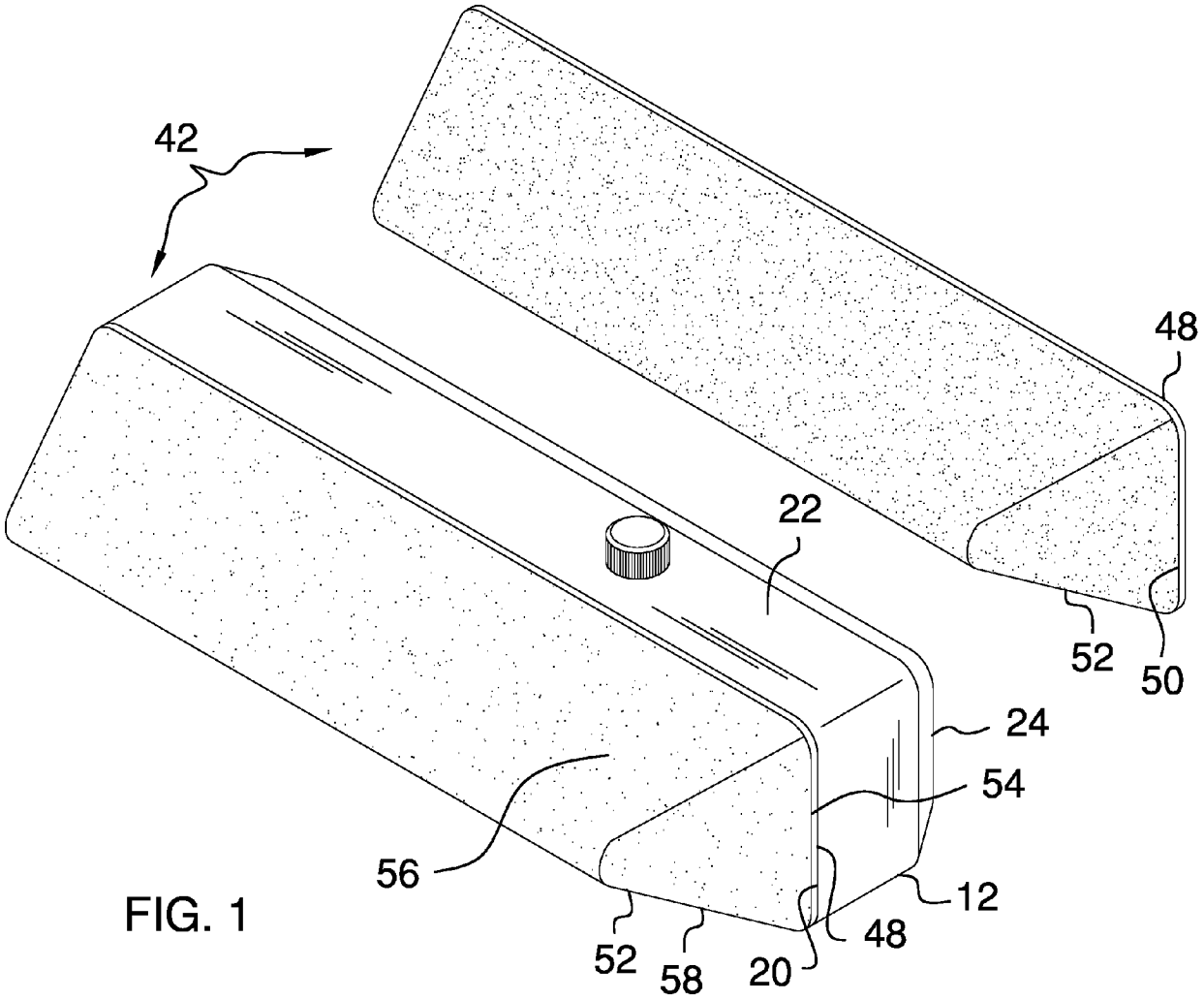
FIG. 1 is a front perspective view of a back scrubbing assembly according to an embodiment of the disclosure.
Figure 2:
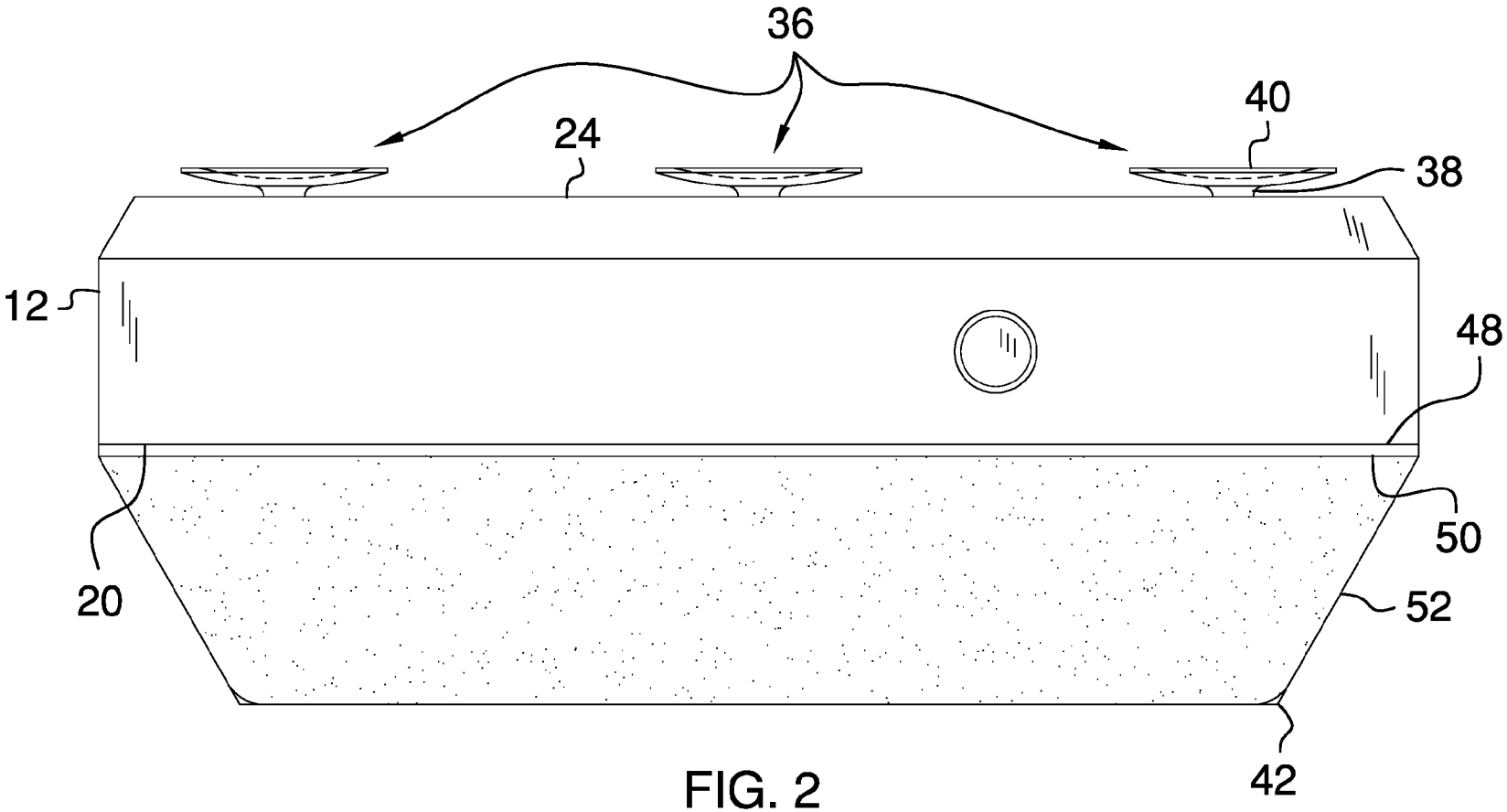
FIG. 2 is a top view of an embodiment of the disclosure.
Figure 3:
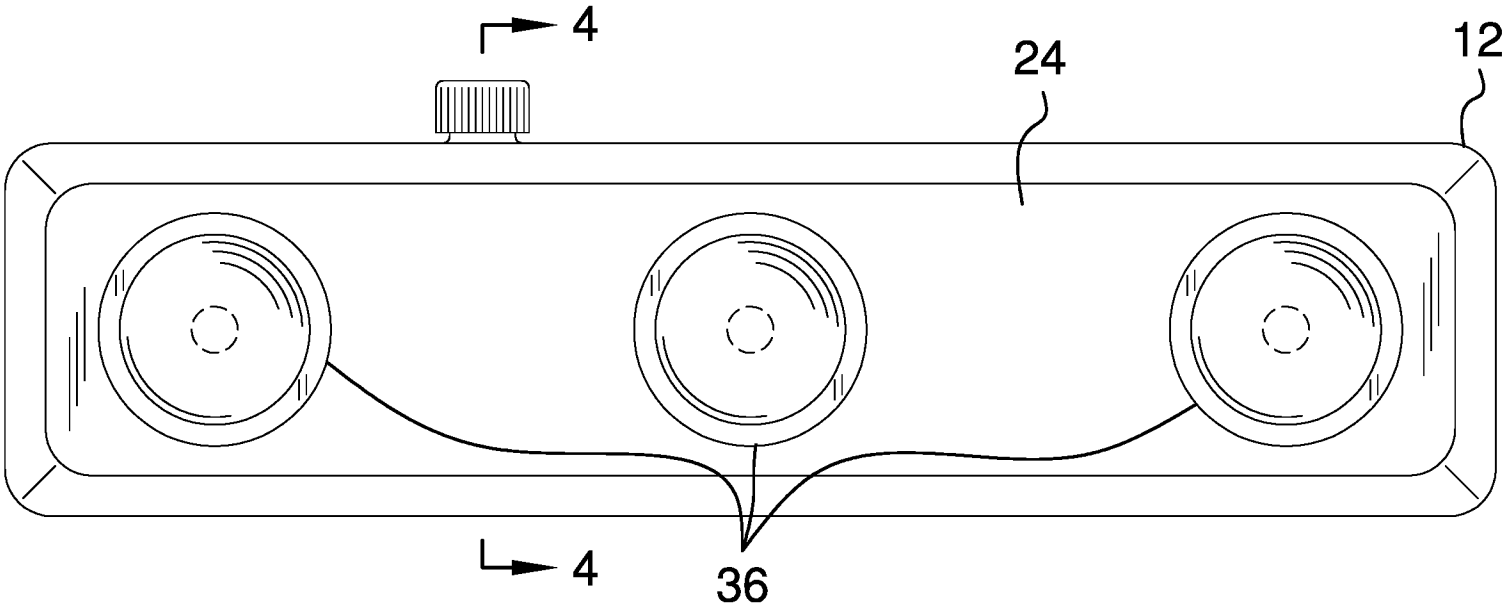
FIG. 3 is a back view of an embodiment of the disclosure.
Figure 4:
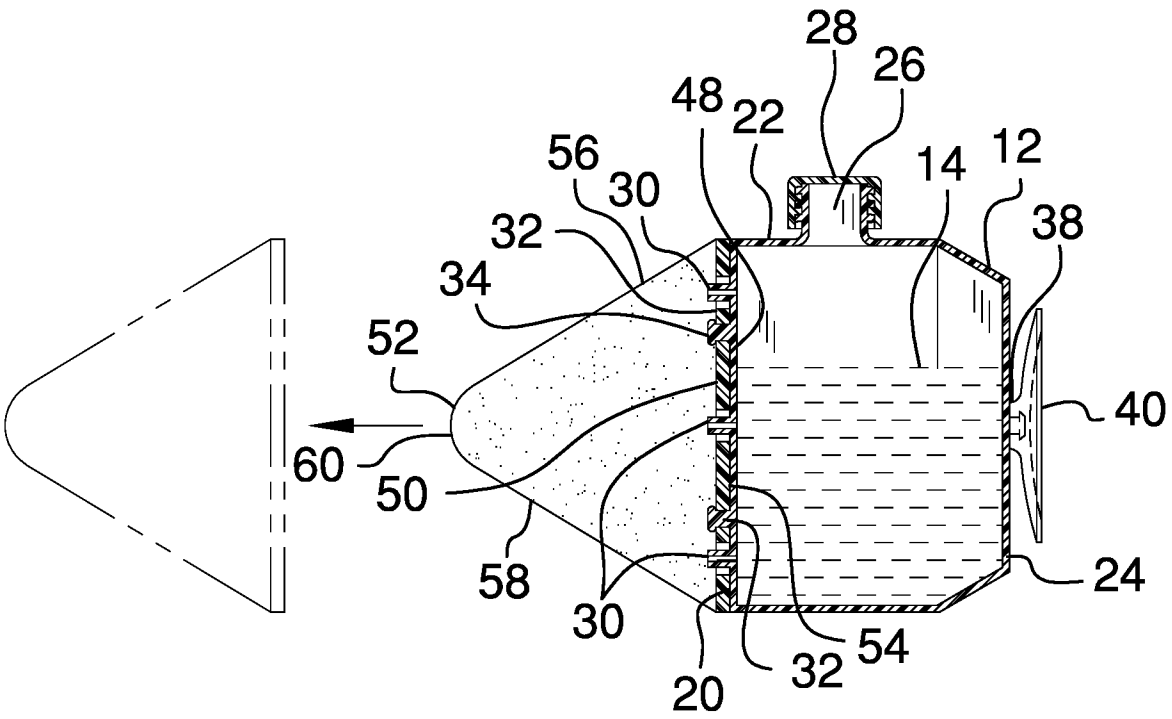
FIG. 4 is a cross sectional view taken along line 4-4 of FIG. 3 of an embodiment of the disclosure.
Figure 5:
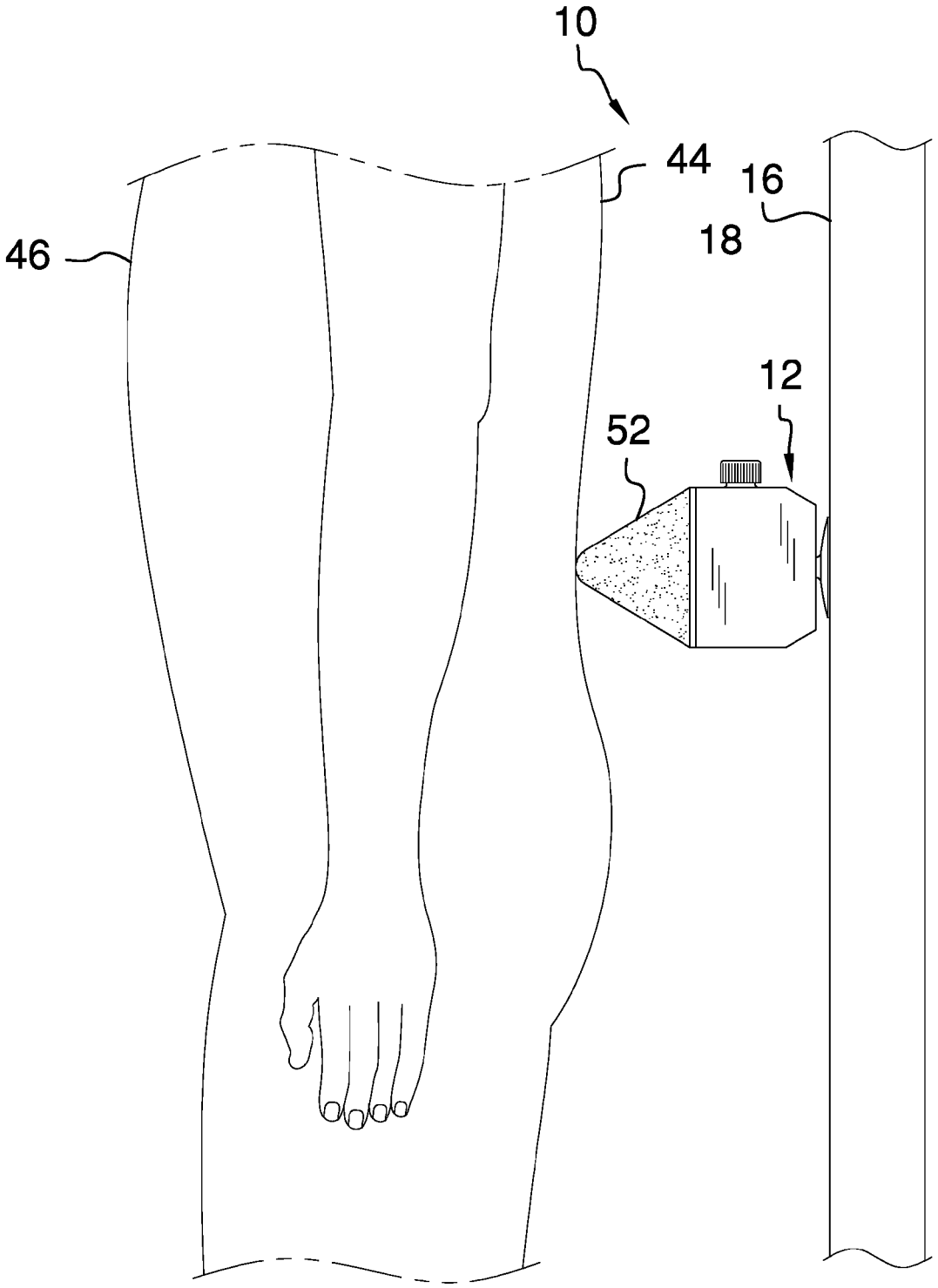
FIG. 5 is a perspective in-use view of an embodiment of the disclosure.

With reference now to the drawings, and in particular to FIGS. 1 through 5 thereof, a new scrubbing device embodying the principles and concepts of an embodiment of the disclosure and generally designated by the reference numeral 10 will be described.

As best illustrated in FIGS. 1 through 5, the back scrubbing assembly 10 generally comprises a reservoir 12 that may be filled with a liquid soap 14. The reservoir 12 may be coupled to a wall 16 in a shower 18. The shower 18 may be a bathing shower or the like. The liquid soap 14 may comprise a liquid bodily soap or the like.

The reservoir 12 has a front wall 20, a top wall 22 and a back wall 24. The top wall 22 has a fill 26 extending into an interior of the reservoir 12. Thus, the fill 26 may have the liquid soap 14 poured therethrough. A cap 28 is removably coupled to the fill 26.

The front wall 20 has a plurality of tubes 30 extending outwardly therefrom. Each of the tubes 30 is in fluid communication with the interior of the reservoir 12. Thus, each of the tubes 30 may release the liquid soap 14 outwardly therefrom. The front wall 20 has a plurality of posts 32 extending outwardly therefrom. Each of the posts 32 may have a head 34 that is spaced from the front wall 20.

A plurality of couplers 36 is provided and each of the couplers 36 is coupled to the reservoir 12. Each of the couplers 36 may engage the wall 16 in the shower 18. Each of the couplers 36 has a stem 38 and a cup 40 that is coupled to the stem 38. The stem 38 is coupled to the back wall 24 and the cup 40 is spaced from the back wall 24. The cup 40 is comprised of a deformable material. Thus, the cup 40 may suctionally engage the wall 16 in the shower 18 when the cup 40 is pressed against the wall 16 in the shower 18.

A plurality of cleaning members 42 is provided. A selected one of the cleaning members 42 is removably coupled to the reservoir 12. Thus, the selected cleaning member 42 may scrub a back 44 of a user 46 when the user 46 bathes in the shower 18. Each of the cleaning members 42 comprises a plate 48 that selectively engages the posts 32 on the reservoir 12. Thus, the plate 48 is removably coupled to the front wall 20. The head 34 on each of the posts 32 may frictionally retain the plate 48 on the front wall 20. Each of the tubes 30 extends through the plate 48 when the plate 48 is removably coupled to the reservoir 12 and the plate 48 has a first surface 50.

A sponge 52 is coupled to the first surface 50 of the plate 48. Thus, the sponge 52 may scrub the user's back 44 when plate 48 is removably coupled to the front wall 20. Each of the tubes 30 extends into the sponge 52 when the plate 48 is removably coupled to the reservoir 12. Thus, the sponge 52 may receive the liquid soap 14 from the tubes 30 thereby enhancing cleaning the user's back 44.

The sponge 52 has a rear side 54, an upper side 56 and a lower side 58. Each of the upper side 56 and the lower side 58 intersects at a point 60 with respect to the rear side 54. The rear side 54 is coupled to the first surface 50 of the plate 48. Thus, the point 60 may frictionally engage the user's back 44.

In use, the cap 28 is removed from the fill 26 and the reservoir 12 is filled with the liquid soap 14. The reservoir 12 is positioned on the wall 16 of the shower 18 such that each of the couplers 36 suctionally engages the wall 16 in the shower 18. The reservoir 12 is positioned at a selected height in the shower 18. The selected cleaning member 42 is coupled to the reservoir 12. The user 46 leans against the sponge 52 while the user 46 bathes. Thus, the user 46 cleans the user's back 44 while the user 46 bathes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A back scrubbing assembly comprising:

a reservoir being configured to be filled with a liquid soap, said reservoir being configured to be coupled to a wall in a shower, said reservoir having a front wall, a top wall and a back wall, said top wall having a fill extending into an interior of said reservoir wherein said fill is configured to have the liquid soap poured therethrough, said front wall having a plurality of tubes extending outwardly therefrom, each of said tubes being in fluid communication with said interior of said reservoir wherein each of said tubes is configured to release the liquid soap outwardly therefrom, said front wall having a plurality of posts extending outwardly therefrom;

a plurality of couplers, each of said couplers being coupled to said reservoir wherein each of said couplers is configured to engage the wall in the shower; and a plurality of cleaning members, a selected one of said cleaning members being removably coupled to said reservoir wherein said selected cleaning member is configured to scrub a back of a user, each of said cleaning members comprises a plate selectively engaging said posts on said reservoir such that said plate is removably coupled to said front wall, each of said tubes extending through said plate when said plate is removably coupled to said reservoir, said plate having a first surface.

2. The assembly according to claim 1, wherein each of said couplers has a stem and a cup being coupled to said stem, said stem being coupled to said back wall having said cup being spaced from said back wall, said cup being comprised of a deformable material wherein said cup is configured to suctionally engage the wall in the shower when said cup is pressed against the wall.

3. The assembly according to claim 1, further comprising a sponge being coupled to said first surface of said plate wherein said sponge is configured to scrub the user's back when plate is removably coupled to said front wall, each of said tubes extending into said sponge when said plate is removably coupled to said reservoir wherein said sponge is configured to receive the liquid soap from said tubes thereby enhancing cleaning the user's back.

4. A back scrubbing assembly comprising:

a reservoir being configured to be filled with a liquid soap, said reservoir being configured to be coupled to a wall in a shower, said reservoir having a front wall, a top wall and a back wall, said top wall having a fill extending into an interior of said reservoir wherein said fill is configured to have the liquid soap poured therethrough, said front wall having a plurality of tubes extending outwardly therefrom, each of said tubes being in fluid communication with said interior of said reservoir wherein each of said tubes is configured to release the liquid soap outwardly therefrom, said front wall having a plurality of posts extending outwardly therefrom;

a cap being removably coupled to said fill;

a plurality of couplers, each of said couplers being coupled to said reservoir wherein each of said couplers is configured to engage the wall in the shower, each of said couplers having a stem and a cup being coupled to said stem, said stem being coupled to said back wall having said cup being spaced from said back wall, said cup being comprised of a deformable material wherein said cup is configured to suctionally engage the wall in the shower when said cup is pressed against the wall; and a plurality of cleaning members, a selected one of said cleaning members being removably coupled to said reservoir wherein said selected cleaning member is configured to scrub a back of a user, each of said cleaning members comprising:

a plate selectively engaging said posts on said reservoir such that said plate is removably coupled to said front wall, each of said tubes extending through said plate when said plate is removably coupled to said reservoir, said plate having a first surface, and a sponge being coupled to said first surface of said plate wherein said sponge is configured to scrub the user's back when plate is removably coupled to said front wall, each of said tubes extending into said sponge when said plate is removably coupled to said reservoir wherein said sponge is configured to receive the liquid soap from said tubes thereby enhancing cleaning the user's back.

* * * * *